US008620197B2

(12) United States Patent
Kawakami

(10) Patent No.: US 8,620,197 B2
(45) Date of Patent: Dec. 31, 2013

(54) DEVELOPER STIRRING MEMBER, DEVELOPING APPARATUS AND PROCESS CARTRIDGE

(75) Inventor: Takuya Kawakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 13/109,138

(22) Filed: May 17, 2011

(65) Prior Publication Data

US 2011/0293332 A1 Dec. 1, 2011

(30) Foreign Application Priority Data

May 26, 2010 (JP) ..... 2010-119993
Apr. 25, 2011 (JP) ..... 2011-096933

(51) Int. Cl.
*G03G 15/08* (2006.01)

(52) U.S. Cl.
USPC ..... 399/263

(58) Field of Classification Search
USPC ..... 399/254, 263
See application file for complete search history.

(56) References Cited

U.S. PATENT DOCUMENTS

| | | | | |
|---|---|---|---|---|
| 6,470,163 | B1 | 10/2002 | Minagawa | |
| 6,701,113 | B2 | 3/2004 | Matsuda et al. | |
| 7,224,925 | B2 * | 5/2007 | Sato et al. | 399/263 |
| 7,529,508 | B2 | 5/2009 | Choi et al. | |
| 7,558,514 | B2 | 7/2009 | Yamamura | |
| 8,005,404 | B2 | 8/2011 | Sato | |
| 8,165,509 | B2 | 4/2012 | Sato | |
| 8,260,176 | B2 * | 9/2012 | Nozawa et al. | 399/254 |
| 2002/0150410 | A1 | 10/2002 | Matsuda et al. | |
| 2006/0222414 | A1 | 10/2006 | Yamamura | |
| 2007/0048024 | A1 | 3/2007 | Choi et al. | |
| 2009/0274491 | A1 | 11/2009 | Sato | |
| 2011/0103846 | A1 * | 5/2011 | Ota | 399/263 |
| 2011/0286772 | A1 | 11/2011 | Sato | |
| 2012/0189356 | A1 | 7/2012 | Sato | |

FOREIGN PATENT DOCUMENTS

| | | | |
|---|---|---|---|
| CN | 1306228 | A | 8/2001 |
| CN | 1920686 | A | 2/2007 |
| CN | 2872422 | Y | 2/2007 |
| CN | 101571694 | A | 11/2009 |
| JP | 2002-296884 | A | 10/2002 |
| JP | 2006-276615 | A | 10/2006 |
| JP | 2007-264253 | A | 10/2007 |

OTHER PUBLICATIONS

Notification of the First Office Action dated Dec. 19, 2012, in Chinese Application No. 201110137598.5.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A developer stirring member for stirring a developer in a developer accommodating portion includes a supporting shaft and a sheet-like member for stirring the developer. The sheet-like member has a first lateral end which is a free end and a second lateral end which is fixed on the supporting shaft. The sheet-like member is waved at the second lateral end, and waving is greater in the second lateral end than in the first lateral end. The sheet like member is fixed to the supporting shaft at intervals which are the same as pitches of the wave.

19 Claims, 6 Drawing Sheets

DEVELOPER STIRRING MEMBER, DEVELOPING APPARATUS AND PROCESS CARTRIDGE

FIELD OF THE INVENTION AND RELATED ART

The present invention relates to a developer stirring member employed by an image forming apparatus which forms images using developer. It also relates to a developer cartridge, a process cartridge, and an image forming apparatus.

An electrophotographic image forming apparatus forms images by forming a toner image on its image bearing member with the use of developer, and transferring the toner image onto recording medium. An image forming apparatus of this type is provided with a developer container for supplying developer to the developer bearing member. Further, in order to enable the developer container to supply the image bearing member with the developer even when the amount of the developer in the developer container is very small, the developer container is provided with a rotatable stirring member, which is disposed in the developer container. Generally, a stirring member comprises: a shaft (supporting shaft); and an elastic sheet which is attached to the shaft and is in contact with the inward surface of the developer container. As the supporting shaft is rotated, the sheet sends the developer toward the developer bearing member while stirring the developer.

Among the stirring members having a stirring sheet, there is such a stirring sheet that has an auxiliary stirring sheet which is for improving the stirring member in stirring efficiency (Japanese Laid-open Patent Application 2007-264253). This auxiliary sheet is in the form of a comb.

Also among the abovementioned stirring members, there is a stirring member provided with multiple stirring sheets which are different in dimension in terms of the direction perpendicular to the lengthwise direction of the stirring member. In the case of this stirring member, in order to reduce the noises which the actual stirring portion (stirring sheet) of the stirring member generates as it released by the body of developer in the developer container, without reducing the stirring member in the vigorousness with which the stirring member can stir the developer, the multiple stirring sheets, different in dimension, are layered to make less rigid the long edge portion of the actual stirring portion of the stirring member, by which the actual stirring portion is not attached to the supporting shaft, than the long edge portion of the actual stirring portion of the stirring member, by which the actual stirring portion is attached to the supporting shaft (Japanese Laid-open Patent Application 2006-276615).

SUMMARY OF THE INVENTION

In order to improve an electrophotographic image forming apparatus in image quality, it is necessary to vigorously stir the developer in the developer container, and also, to stir the developer so that it becomes uniform in properties. If the developer in the developer container is not vigorously stirred and/or is not stirred so that it becomes uniform in properties, it is possible that the amount by which the developer is conveyed to a developing means per unit area of the peripheral surface of the developing means will vary, and/or the toner particles will become different in the amount of electrical charge. If the amount by which the developer is conveyed to a developing means per unit area of the peripheral surface of the developing means varies, and/or the toner particles in the developer become nonuniform in the amount of electric charge, it is possible that an electrophotographic image forming apparatus will output images which suffer from unwanted white spots, and/or are nonuniform in density.

In order to improve a stirring member in the level of vigorousness with which it can stir developer, it is necessary to provide the developer container with an additional member or additional members which contribute to the stirring of the developer, and/or replace the material for the stirring member with a substance which is higher in rigidity than ordinary substances used as the conventional materials for the stirring member. In either case, the stirring member is liable to increase in cost.

As another means for improving a stirring member in the strength for stirring developer, it is possible to use a corrugated sheet as the material for a stirring sheet to improve the stirring sheet in the resistance to bending. In the case of this means, the corrugation is liable to make the stirring member nonuniform in stirring force in terms of the lengthwise direction of the stirring member, which in turn is liable to cause an electrophotographic image forming apparatus to output images which are nonuniform in density in terms of the lengthwise direction of the stirring member.

The present invention is for solving the above described problems. Thus, the primary object of the present invention is to provide a developer stirring member, a developing apparatus, and a process cartridge, which can vigorously stir the developer in a developer container, and also, can uniformly stir the developer in terms of the lengthwise direction of the stirring member, without requiring an auxiliary stirring member or auxiliary stirring members.

According to an aspect of the present invention, there is provided a developer stirring member for stirring a developer in a developer accommodating portion, said developer stirring member comprising a supporting shaft; a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end.

According to another aspect of the present invention, there is provided a developing device for supplying a developer to a photosensitive drum in an image forming apparatus, said developing device comprising a developer accommodating portion accommodating the developer; a supporting shaft; a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end.

According to a further aspect of the present invention, there is provided a process cartridge detachably mountable to a main assembly of an image forming apparatus, said process cartridge comprising a photosensitive drum: a developer carrying member for developing a latent image formed on said photosensitive drum with a developer; a developer accommodating portion accommodating the developer; a supporting shaft; a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention is described referring to the electrophotographic image forming apparatus in the preferred embodiments of the present invention, with reference to the appended drawings.

Embodiment 1

General Structure of Electrophotographic Image Forming Apparatus

An "electrophotographic image forming apparatus" (which hereafter may be referred to simply as image forming apparatus) is an apparatus which forms images on recording medium, such as a sheet of recording paper, a sheet for OHP, a piece of fabric, etc., with the use of an electrophotographic image formation process. Examples of an electrophotographic image forming apparatus include an electrophotographic copying machine, an electrophotographic printer (for example, laser beam printer, LED printer, and the like), a facsimile machine, a word processor, and the like. However, the preferred embodiments of the present invention are described with reference to a laser printer.

Further, a "process cartridge" employed by an electrophotographic image forming apparatus means such a cartridge that comprises: an electrophotographic photosensitive member; charging means, developing means, or cleaning means; and a cartridge (shell) in which the preceding components are integrally contained, so that they can be removably mounted in the main assembly of an image forming apparatus. A "process cartridge" means also such a cartridge that comprises: at least one (image forming means) among charging means, developing means, and cleaning means; an electrophotographic photosensitive member; and a cartridge (shell) in which the preceding components are integrally contained so that they can be removably mounted in the main assembly of an electrophotographic image forming apparatus.

Figure 2:
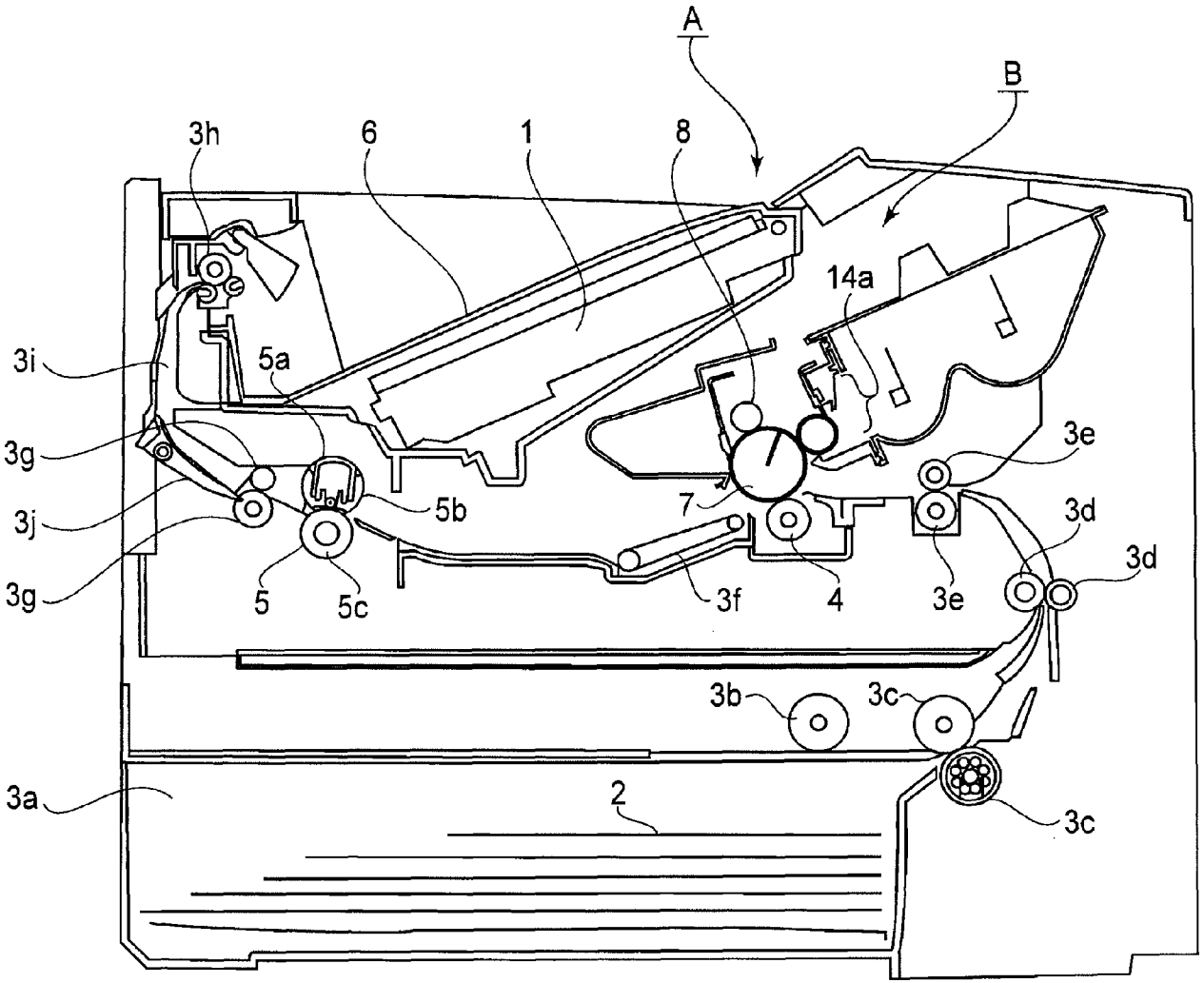
FIG. 2 is a schematic sectional view of the image forming apparatus in the first preferred embodiment of the present invention, and shows the general structure of the apparatus.

First, referring to FIG. 2, the main assembly A of the image forming apparatus in this embodiment is described.

An electrophotographic photosensitive member 7 (which hereafter is referred to simply as photosensitive drum) is uniformly charged by a charge roller 8, which is a charging means. A latent image, which reflects the information of an image to be formed, is formed on the photosensitive drum 7 by projecting a beam of laser light by an optical means 1 which has a laser diode, a polygon mirror, lenses, and a deflection mirror, while modulating the beam in accordance with the information of the image to be formed. This latent image is developed into a visible image (image formed of toner) by a developing means, which uses developer (which hereafter may be referred to as toner). The visible image hereafter is referred to as a toner image.

Meanwhile, in synchronism with the formation of the toner image, one of the sheets 2 of recording medium set in a sheet feeder cassette 3*a* is conveyed by a pickup roller 3*b*, a pair of conveyance rollers 3*c*, a pair of conveyance rollers 3*d*, and a pair of conveyance rollers 3*e*, to a transfer position in which a transfer roller 4 is disposed as a transferring means. The toner image on the photosensitive drum 7 is transferred onto the sheet 2 of recording medium by the application of voltage to the transfer roller 4.

After the transfer of the toner image onto the sheet 2 of recording medium, the sheet 2 is conveyed to a fixing means 5 while being guided by a conveyance guide 3*f*. Then, the sheet 2 is conveyed through the fixing means 5. The fixing means 5 has: a driver roller 5*c*; and a fixation roller 5*b* which contains a heater 5*a*. While the sheet 2 is conveyed through the fixing means 5, the fixing means 5 fixes the toner image on the sheet 2, to the sheet 2, by applying heat and pressure to the sheet 2 and the toner image thereon. Thereafter, the sheet 2 of recording medium is conveyed further by a pair of discharge rollers 3*g* and a pair of discharge rollers 3*h*, and then, is discharged into a delivery tray 6 by way of a turnover path 3*i*. The delivery tray 6 is a part of the top surface of the main assembly of the image forming apparatus. Incidentally, a flapper 3*j*, which is rotationally movable, can be changed in position to discharge the sheet 2 of recording medium without putting the sheet 2 through the turnover path 3*i*. The above-mentioned pickup roller 3*b*, pairs 3*c*, 3*d*, and 3*e* of conveyance rollers, conveyance guide 3*f*, and pairs 3*g* and 3*h* of conveyance rollers, etc., make up recording medium conveying means.

[Structure of Process Cartridge]

Figure 3:
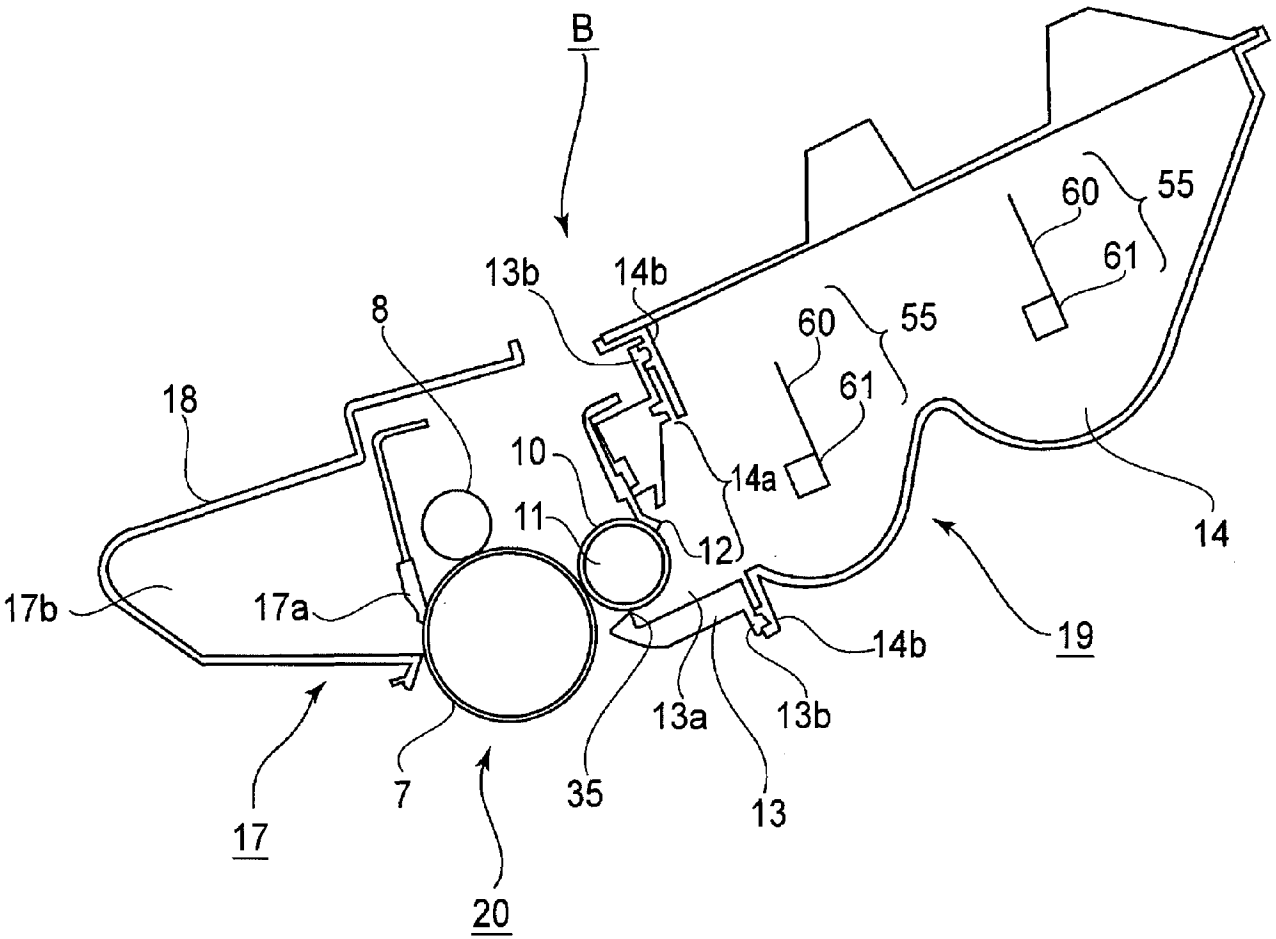
FIG. 3 is a schematic sectional view of the process cartridge in the first preferred embodiment of the present invention.

Next, referring to FIG. 3, the process cartridge B is described. A photosensitive member unit 20 comprises: the photosensitive drum 7; a charge roller 8 which is in contact with the photosensitive drum 7, and is rotated by the rotation of the photosensitive drum 7; an elastic cleaning blade 17*a*; and a cleaning means 17 which has a waste toner chamber, as shown in FIG. 3.

A developing apparatus 19 is a means for developing the aforementioned latent image. It has a developer bearing member 10 (which hereafter is referred to as development roller 10) which develops an electrostatic latent image formed on the photosensitive drum 7. It has also a magnetic roller 11 (stationary magnet), which is in the hollow of the development roller 10. Further, the developing apparatus 19 has a developer container 14, which is a container for holding developer (toner). The developer container 14 has an opening 14*a* through which developer is supplied to the development roller 10. Further, the developer container 14 has a developer stirring member 55, which is rotatable and is in the developer container 14. The developing apparatus 19 has also a development blade 12, which not only regulates the amount by which the developer is allowed to remain borne on the peripheral surface of the development roller 10 per unit area of the peripheral surface, but also, gives the toner particles triboelectric charge. It also has a leak prevention sheet 35 (which hereafter is referred to as blow-out prevention sheet 35). Further, the developing apparatus 19 has a developing means frame 13 which supports the development roller 10 and development blade 12.

The developer container 14 and developing means frame 13 are in connection with each other; the flange 14*b* of the developer container 14 and the flange 13*b* of the developing means frame 13 are attached to each other by such a means as welding.

When the process cartridge B is brand-new, its opening 14*a* is kept sealed with a developer seal (unshown), in order to ensure that toner developer does not leak from the process cartridge B while the cartridge B is transported. The developer seal is to be removed by a user to unseal the opening 14*a*.

As for the transmission of driving force to the photosensitive drum 7 and the other components to be driven, the driving force from the main assembly A of the image forming apparatus is transmitted to each component through a gear train which comprises a drum gear, a sleeve gear, and a stirring gear, which are in mesh with each other in the listed order. The drum gear is attached to the photosensitive drum 7, and rotates with the photosensitive drum 7. The sleeve gear is attached to the development roller 10, and rotates with the development roller 10. The stirring member gear is attached to the stirring member 55, and rotates with the stirring member 55.

[Structure of Stirring Member]

Figure 1:
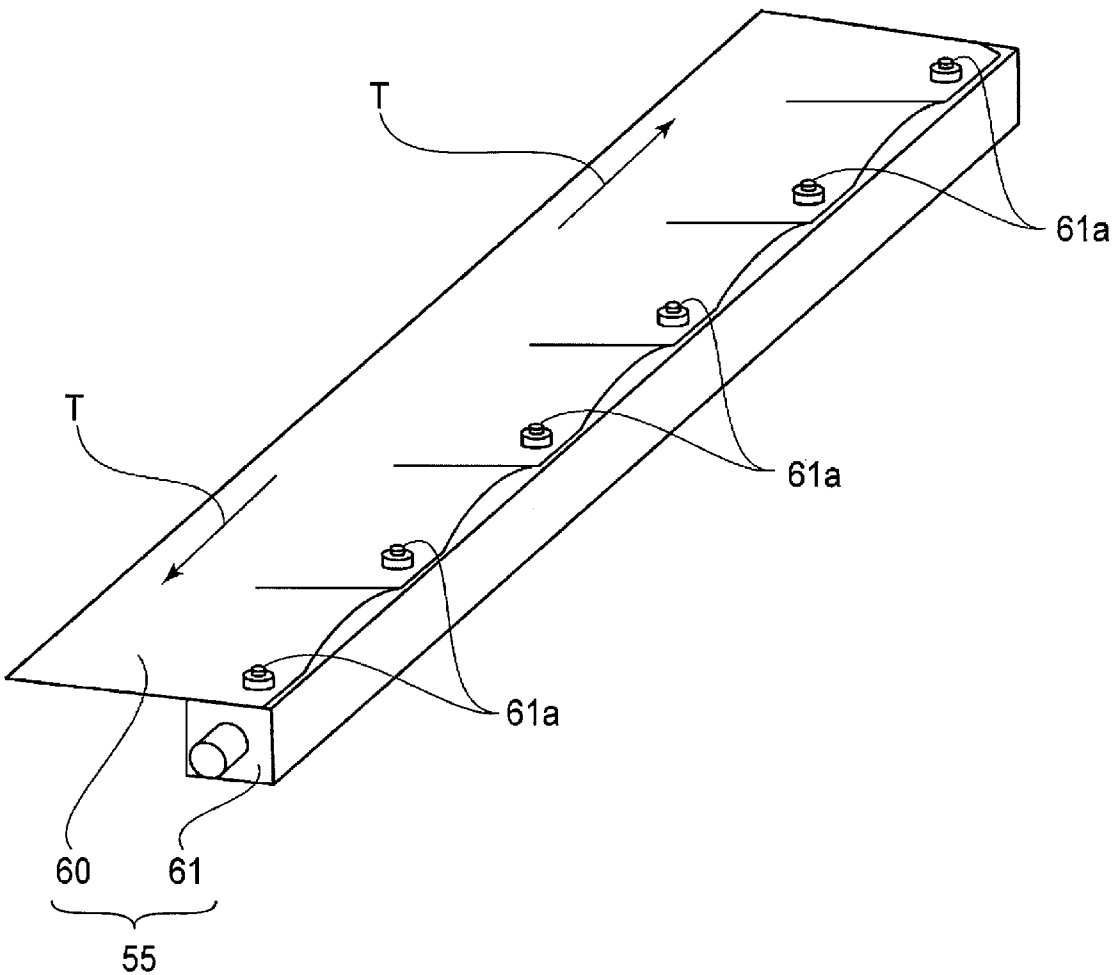
FIG. 1 is a perspective view of the stirring member in the first preferred embodiment of the present invention.
Figure 4:
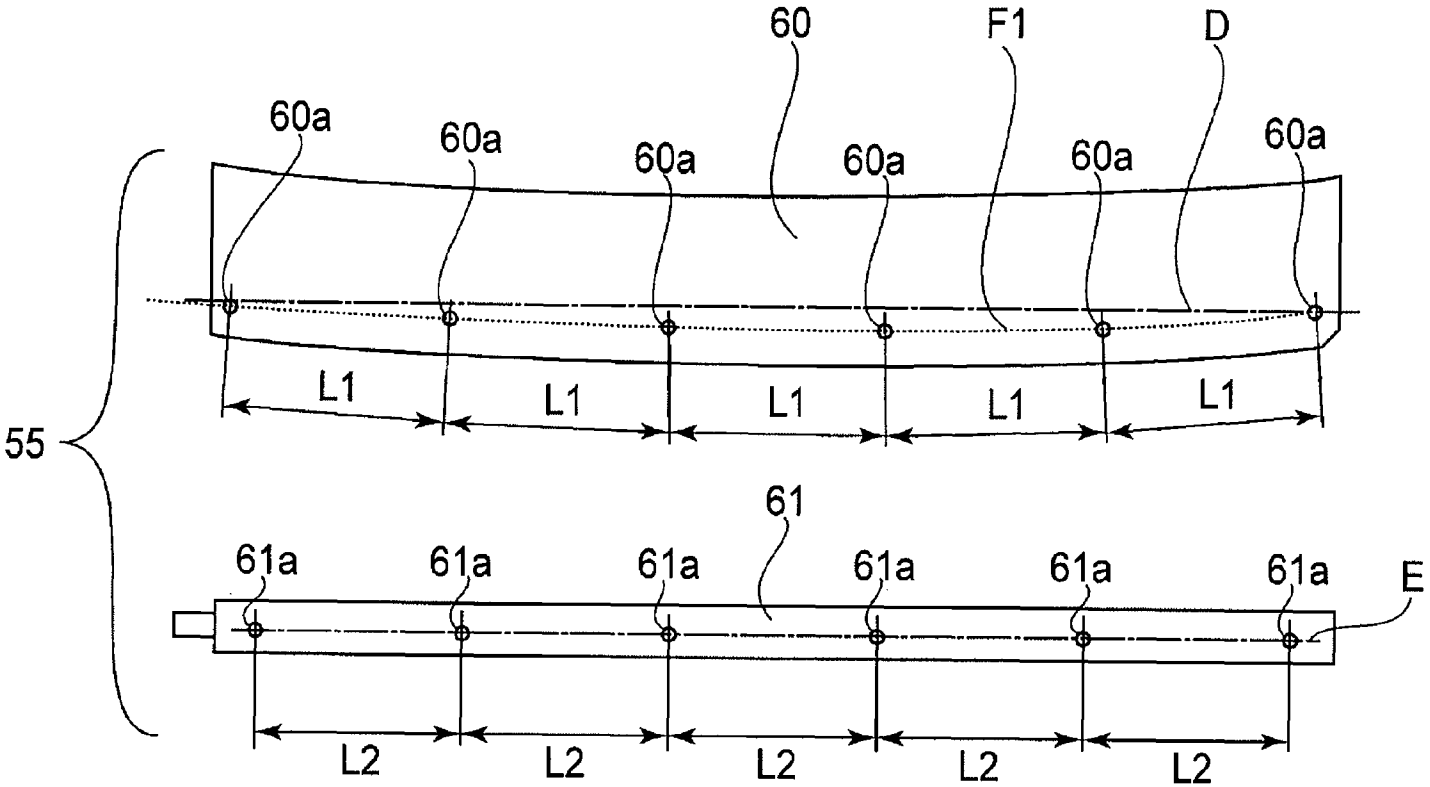
FIG. 4 is a plan view of the stirring member in the first preferred embodiment of the present invention prior to the assembly of the stirring member.

Next, referring to FIGS. 1 and 4, the structure of the stirring member 55 is described. The stirring member 55 comprises a sheet supporting shaft 61 (which hereafter is referred to simply as supporting shaft 61) and an elastic sheet 60, as shown in FIGS. 1 and 4. The supporting shaft 61 has multiple short sheet anchoring projections 61*a* with which the elastic sheet 60 is attached to the supporting shaft 61, whereas the elastic sheet 60 has multiple holes 60*a*, into which the projections 61*a* of the supporting shaft 61 fit one for one. The multiple holes 60*a* are next to one of the long edges of the elastic sheet 60. A referential code E stands for the straight line (first straight line) which connects the two projections 61*a* which are at the lengthwise ends of the supporting shaft 61, one for one. A referential code D stands for the straight line (second straight line) which connects the two holes 60*a* of the elastic sheet 60, which are at the lengthwise ends of the elastic sheet 60, one for one. Incidentally, it is by one of the long edge portions of the elastic sheet 60 that the elastic sheet 60 is attached to the supporting shaft 61, whereas the other long edge portion of the elastic sheet 60 is unattached.

The multiple sheet anchoring projections 61*a* are on the straight line E. On the other hand, the multiple holes 60*a* of the elastic sheet 60 are on a curved line F1, the curvature of which resembles the curvature of a bow. The stirring member is structured so that when the elastic sheet 60 and supporting shaft 61 are positioned so that the straight line D coincides with the straight line E, the sheet anchoring projections 61*a* other than the two which are at the lengthwise ends of the shaft 61 one for one are closer to the free long edge portion of the elastic sheet 60, that is, the long edge portion of the elastic sheet 60, by which the elastic sheet 60 is not attached to the supporting shaft 61, than the corresponding holes 60*a* of the elastic sheet 60, and also, so that the interval L1 between the adjacent two holes 60*a* is greater than the interval L2 of the adjacent two projections 61*a* (L1>L2).

The multiple projections 61*a* of the supporting shaft 61 are fitted into the holes 60*a* of the elastic sheet 60 one for one, by deforming the elastic sheet 60. Then, the tip portion of each projection 60*a* is thermally melted to anchor the elastic sheet 60 to the supporting shaft 61 as shown in FIG. 1.

Since L1>L2, fitting the sheet anchoring projections 61 into the multiple holes 60*a* of the elastic sheet 60 causes the elastic sheet 60 to corrugate in the lengthwise direction of the elastic sheet 60.

Further, the supporting shaft 61 and elastic sheet 60 are designed so that as the shaft 61 and sheet 60 are aligned so that the straight lines D and E coincide with each other, the projections 61*a* other than the two projections 61*a* which are at the lengthwise ends, one for one, of the shaft 61 will be closer to the lengthwise edge portion of the elastic sheet 60, by which the elastic sheet 60 is not attached to the shaft 61, than the corresponding holes 60*a* of the elastic sheet 60. Therefore, a tensional force T is generated in the lengthwise direction of the elastic sheet 60, across the unattached long edge portion of the elastic sheet 60. Thus, the corrugation of the elastic sheet 60 is such that the closer to the unattached long edge portion, the less it is the corrugated.

Thus, the elastic sheet 60 in this embodiment, which is corrugated in its lengthwise direction, is less likely to bend, being therefore capable of more vigorously stirring the developer, than the elastic sheet (60) of any stirring member (61) in accordance with the prior art. Further, the elastic sheet 60 in this embodiment is such that its unattached long edge portion is microscopic in corrugation compared to its attached long edge portion. Therefore, the stirring member 61 in this embodiment can uniformly stir the developer in the developer container, in terms of its lengthwise direction.

As described above, in this embodiment, the stirring member 55 which has the developer stirring elastic sheet 60 and elastic sheet supporting shaft 61, is structured so that the corrugation of the elastic sheet 60 is such that the unattached long edge portion of the elastic sheet 60 is microscopic in corrugation compared to the attached long edge portion of the elastic sheet 60. With this structural arrangement, it is possible to anchor the elastic sheet 60 to the supporting shaft 61 in such a manner that the unattached long edge portion of the elastic sheet 60 is greater in tension than the attached long edge portion of the elastic sheet 60.

That is, this embodiment of the present invention can increase the elastic sheet 60 in terms of its resistance to bending, and therefore, can increase the elastic sheet 60 in the amount of force which it can apply to the developer to stir the developer. Thus, this embodiment makes it possible to prevent an electrophotographic image forming apparatus from outputting images which suffer from unwanted white spots, without the need for an auxiliary stirring member, or requiring that the material for the stirring member 55 is replaced with a substance which is significantly higher in rigidity than any of the conventional materials for a developer stirring member.

Further, this embodiment of the present invention can make a developer stirring member uniform in developer stirring force across the developer stirring member in terms of the lengthwise direction of the developer stirring member, being therefore capable of preventing an electrophotographic image forming apparatus from outputting images which are nonuniform in density.

Embodiment 2

Figure 5:
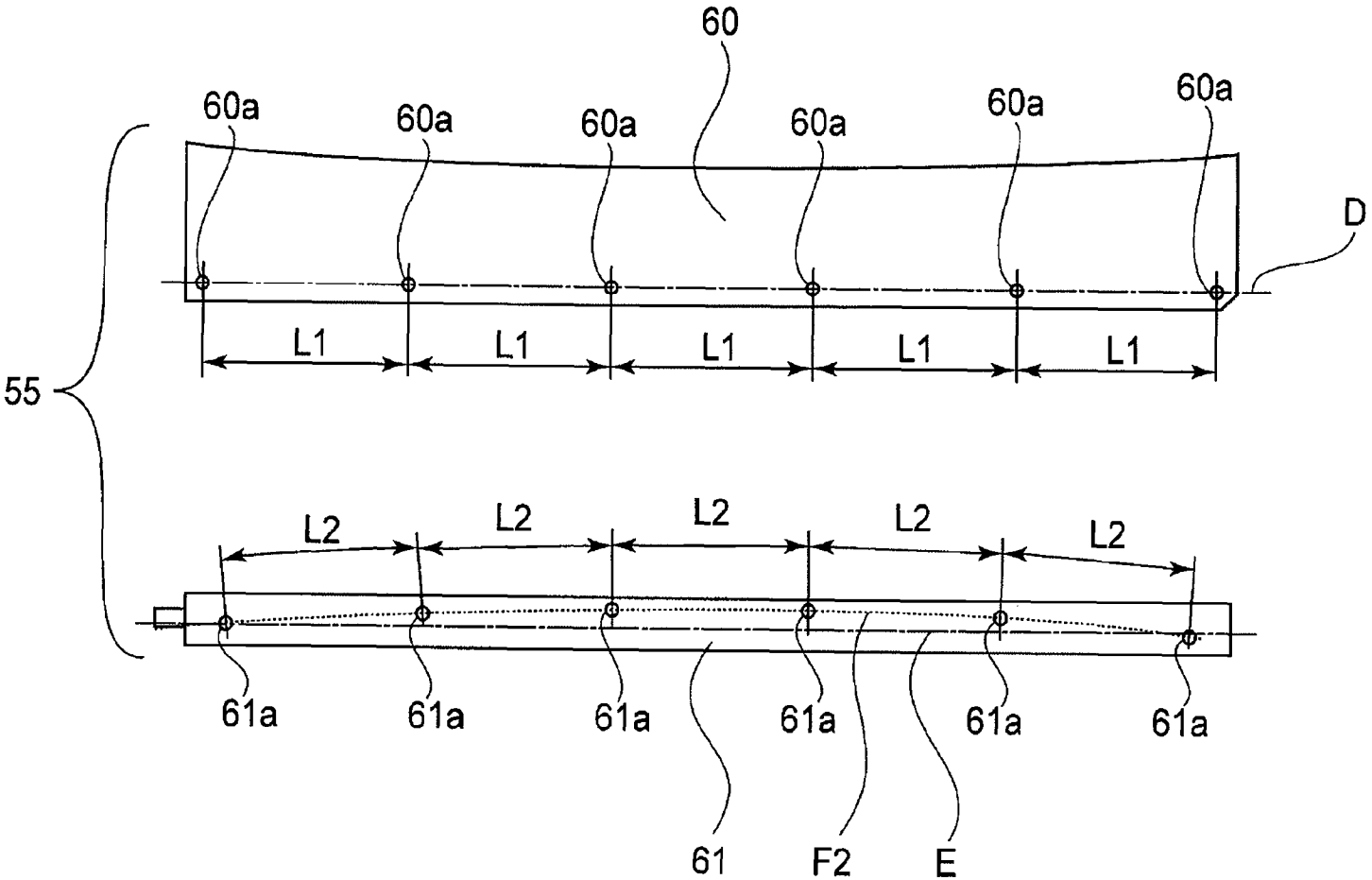
FIG. 5 is a plan view of the stirring member in the second preferred embodiment of the present invention prior to the assembly of the stirring member.
Figure 6:
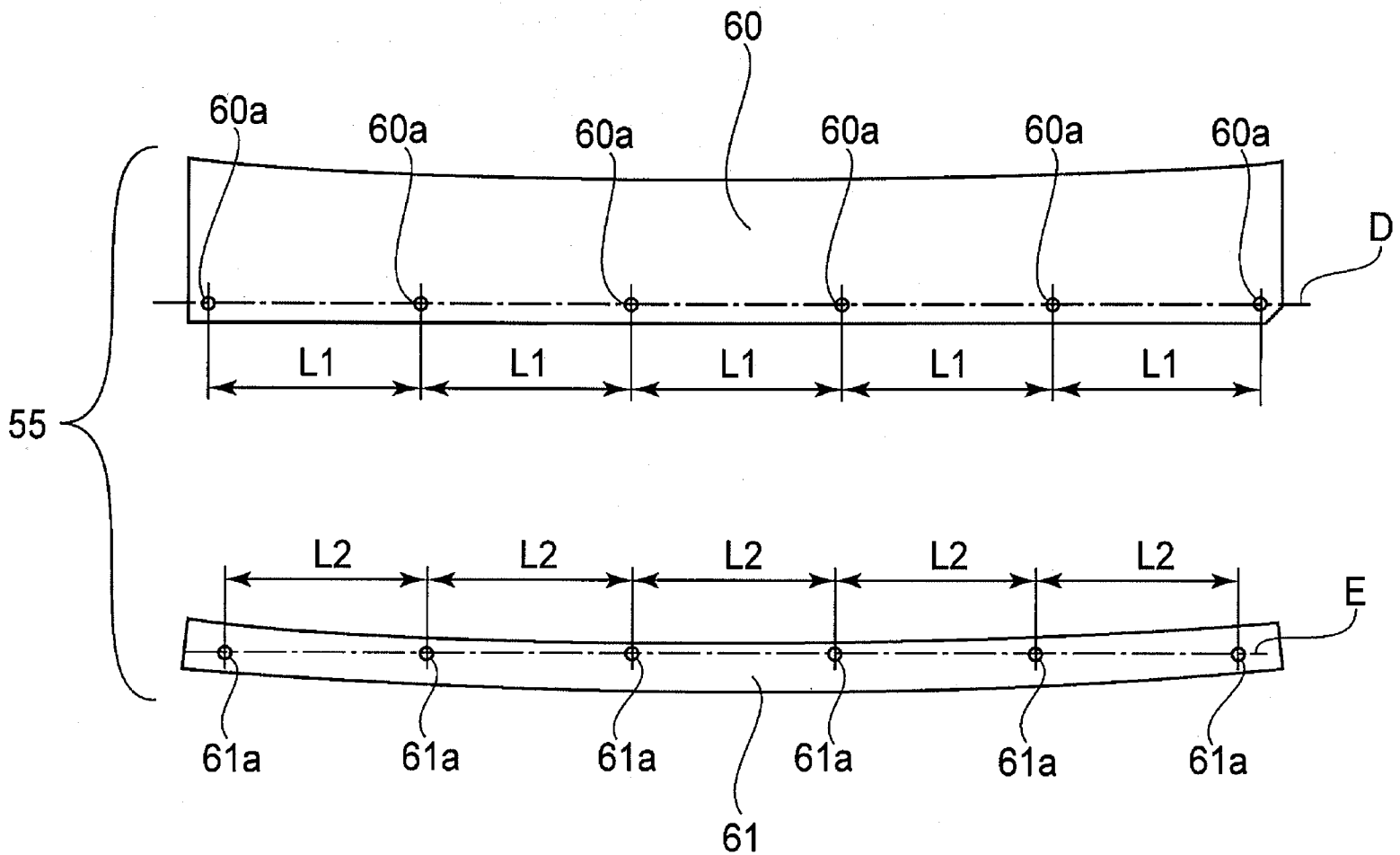
FIG. 6 is a plan view of the stirring member in the second preferred embodiment of the present invention, which shows how the supporting shaft of the stirring member is deformed (bent) during the assembly of the stirring member.

Next, referring to FIGS. 5 and 6, the second preferred embodiment of the present invention is described. The process cartridge components in this embodiment, which are the equivalent in structure and function to the counterparts in the first preferred embodiment, are given the same referential codes as those given to the counterparts, and will not be described in detail.

In the first preferred embodiment, the stirring member 55 was structured so that the sheet attachment projections 61*a* of the supporting shaft 61 were on the straight line E (first straight line), and the holes 60*a* of the elastic sheet 60 were on a curved line having a gentle curvature like a bow.

In comparison, in this embodiment, the stirring member 61 is structured as shown in FIG. 5. That is, it is structured so that the holes 60*a* are on the straight line D, whereas the sheet anchoring projections 61*a* are on the curved line F2 which has a curvature like the curvature of a bow, and also, so that when the shaft 61 and elastic sheet 60 are positioned to make the straight lines D and E coincide with each other, the projections 61*a* other than the two at the lengthwise ends of the shaft 61 are on the unattached long edge side of the elastic sheet 60 relative to the corresponding holes 60*a*.

The elastic sheet 60 is attached to the supporting shaft 61 as shown in FIG. 6. That is, first, the supporting shaft 61 is to be deformed like a bow with the use of an unshown apparatus so that all the projections 61*a* align roughly straight. Then, the elastic sheet 60 is to be aligned with the shaft 61 so that the holes 60*a* of the elastic sheet 60 align with the projections 61*a* of the supporting shaft 61 one for one. Then, the elastic sheet 60 is to be attached to the shaft 61 so that the projections 61*a* fit into the corresponding holes 60*a*. Thereafter, the tip portion of each projection 61*a* is to be thermally melted to ensure that the elastic sheet 60 remains attached to the supporting shaft 61. Then, the supporting shaft 61 is to be removed from the abovementioned shaft bending apparatus. As the supporting shaft 61 is removed from the shaft bending apparatus, the long edge portion of the elastic sheet 60, by which the elastic is not attached to the supporting shaft 61, is tensioned in its lengthwise direction by the resiliency of the supporting shaft 61.

As described above, in this embodiment, when the elastic sheet 60 is attached to the supporting shaft 61, the unattached long edge portion of the elastic sheet 60 is not tensioned in its lengthwise direction. Therefore, the stirring member 55 in this embodiment is easier to assemble than the stirring member 55 in the first embodiment.

Also as described above, like the first preferred embodiment, this embodiment also makes it possible to prevent an image forming apparatus from outputting images which have unwanted white spots, and/or are nonuniform in density, without requiring an auxiliary stirring member and/or requiring the material for the stirring member 55 to be replaced with a substance which is significantly higher in rigidity than any of the conventional materials for the stirring member 55. Also in the case of this embodiment, when the elastic sheet 60 is attached to the supporting shaft 61, the long edge portion of the elastic sheet 60, by which the elastic sheet 60 is not attached to the supporting shaft 61, is not tensioned in its lengthwise direction. Therefore, the stirring member 55 in this embodiment is easier to assemble than the stirring member 55 in this first embodiment.

Miscellaneous Embodiments

In the preceding embodiments of the present invention, it was the process cartridge that was provided with the stirring member 55. However, the present invention is also applicable to a developer cartridge, that is, a cartridge which is for supplying a developing apparatus with developer and is removably mountable in the main assembly of an electrophotographic image forming apparatus. The effects of the application of the present invention to a developer cartridge will be just as good as those obtained by the above described application of the present invention to a developing apparatus. Further, not only is the stirring member 55 described above usable with a process cartridge which is removably mountable in the main assembly of an electrophotographic image forming apparatus, but also, with a developing apparatus which is an integral part of the main assembly of an electrophotographic image forming apparatus.

As will be understood from the foregoing, in an embodiment, the sheet-like member is fixed to the supporting shaft at intervals which are the same as pitches of the wave shape.

In addition, in an embodiment, the sheet-like member having a plurality of portions-to-be-fixed at first intervals to the supporting shaft at a plurality of fixing portions which are provided on the supporting shaft at second intervals smaller than the first intervals.

Furthermore, in an embodiment, the first intervals are larger than the corresponding second intervals except for longitudinal end portions of the sheet-like member before the sheet-like member is fixed to the supporting shaft.

Additionally, in an embodiment, the portions-to-be-fixed are arranged on an arcuate line, and the fixing portions are arranged on a straight line before the sheet-like member is fixed to the supporting shaft.

Moreover, in an embodiment, the portions-to-be-fixed are arranged on a straight line, and the fixing portions are arranged on an arcuate line before said sheet-like member is fixed to said supporting shaft.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 119993/2010 and 096933/2011 filed May 26, 2010 and Apr. 25, 2011, respectively which are hereby incorporated by reference.

What is claimed is:

1. A developer stirring member for stirring a developer in a developer accommodating portion, said developer stirring member comprising:

a supporting shaft;

a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end, wherein said sheet like member is fixed to said supporting shaft at intervals which are the same as pitches of the wave.

2. A developer stirring member according to claim 1, wherein the first lateral end is linear.

3. A developer stirring member according to claim 1, wherein a tension in said sheet-like member in a longitudinal direction thereof is larger in the free end than in the fixed end.

4. A developer stirring member for stirring a developer in a developer accommodating portion, said developer stirring member comprising:

a supporting shaft;

a sheet like member for stirring said developer, said sheet like member having a first lateral end which is a free end and having a second lateral end which is fixed on said supporting shaft, wherein said sheet like member is waved at the second lateral end, and waving is greater in the second lateral end than in the first lateral end, wherein said sheet-like member having a plurality of portions-to-be-fixed at first intervals is fixed to said supporting shaft at a plurality of fixing portions which are provided on said supporting shaft at second intervals smaller than the first intervals.

5. A developer stirring member according to claim 4, wherein the portions-to-be-fixed are arranged on an arcuate line, and the fixing portions are arranged on a straight line before said sheet-like member is fixed to said supporting shaft.

6. A developer stirring member according to claim 4, wherein the portions-to-be-fixed are arranged on a straight line, and the fixing portions are arranged on an arcuate line before said sheet-like member is fixed to said supporting shaft.

7. A developing device for supplying a developer to a photosensitive drum in an image forming apparatus, said developing device comprising:

a developer accommodating portion accommodating the developer;

a supporting shaft;

a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end, wherein said sheet like member is fixed to said supporting shaft at intervals which are the same as pitches of the wave.

8. A developer device according to claim 7, wherein the first lateral end is linear.

9. A developing device according to claim 7, wherein a tension in said sheet-like member in a longitudinal direction thereof is larger in the free end than in the fixed end.

10. A developing device according to claim 7, wherein said developing device is detachably mountable to said image forming apparatus.

11. A developing device for supplying a developer to a photosensitive drum in an image forming apparatus, said developing device comprising:

a developer accommodating portion accommodating the developer;

a supporting shaft;

a sheet like member for stirring said developer, said sheet like member having a first lateral end which is a free end and having a second lateral end which is fixed on said supporting shaft, wherein said sheet like member is waved at the second lateral end, and waving is greater in the second lateral end than in the first lateral end, wherein said sheet-like member having a plurality of portions-to-be-fixed at first intervals is fixed to said supporting shaft at a plurality of fixing portions which are provided on said supporting shaft at second intervals smaller than the first intervals.

12. A developing device according to claim 11, wherein the portions-to-be-fixed are arranged on an arcuate line, and the fixing portions are arranged on a straight line before said sheet-like member is fixed to said supporting shaft.

13. A developing device according to claim 11, wherein the portions-to-be-fixed are arranged on a straight line, and the fixing portions are arranged on an arcuate line before said sheet-like member is fixed to said supporting shaft.

14. A process cartridge detachably mountable to a main assembly of an image forming apparatus, said process cartridge comprising:

a photosensitive drum:

a developer carrying member for developing a latent image formed on said photosensitive drum with a developer;

a developer accommodating portion accommodating the developer;

a supporting shaft;

a sheet-like member for stirring said developer, said sheet-like member having a first lateral end which is a free end and having a second lateral end which is fixed on said supporting shaft, wherein said sheet-like member is waved at the second lateral end, and waving is greater in the second lateral end than in the first lateral end, wherein said sheet like member is fixed to said supporting shaft at intervals which are the same as pitches of the wave.

15. A process cartridge according to claim 14, wherein the first lateral end is linear.

16. A process cartridge according to claim 14, wherein a tension in said sheet-like member in a longitudinal direction thereof is larger in the free end than in the fixed end.

17. A process cartridge detachably mountable to a main assembly of an image forming apparatus, said process cartridge comprising:

a photosensitive drum;

a developer carrying member for developing a latent image formed on said photosensitive drum with a developer;

a developer accommodating portion accommodating the developer;

a supporting shaft;

a sheet like member for stirring said developer, said sheet like member having a first lateral end which is a free end and having a second lateral end which is fixed on said supporting shaft, wherein said sheet like member is waved at the second lateral end, and waving is greater in the second lateral end than in the first lateral end, wherein said sheet-like member having a plurality of portions-to-be-fixed at first intervals is fixed to said supporting shaft at a plurality of fixing portions which are provided on said supporting shaft at second intervals smaller than the first intervals.

18. A process cartridge according to claim 17, wherein the portions-to-be-fixed are arranged on an arcuate line, and the fixing portions are arranged on a straight line before said sheet-like member is fixed to said supporting shaft.

19. A process cartridge according to claim 17, wherein the portions-to-be-fixed are arranged on a straight line, and the fixing portions are arranged on an arcuate line before said sheet-like member is fixed to said supporting shaft.

* * * * *